US005626192A

United States Patent [19]

Connell et al.

[11] Patent Number: 5,626,192

[45] Date of Patent: May 6, 1997

[54] COILED TUBING JOINT LOCATOR AND METHODS

[75] Inventors: Michael L. Connell, Duncan, Okla.; Jack G. Clemens, Plano; John J. Goiffon, Dallas, both of Tex.

[73] Assignee: Halliburton Energy Services, Inc., Duncan, Okla.

[21] Appl. No.: 603,960

[22] Filed: Feb. 20, 1996

[51] Int. Cl.[6] ..... E21B 47/09

[52] U.S. Cl. ..... 166/255.1; 166/64; 166/66; 166/66.5; 73/152.01; 73/152.57

[58] Field of Search ..... 166/255.1, 64, 166/66, 66.5, 66.7, 67; 73/152.01, 152.02, 152.37, 152.57

[56] References Cited

U.S. PATENT DOCUMENTS

| | | | |
|---|---|---|---|
| 3,106,960 | 10/1963 | Doak | 166/64 X |
| 3,291,208 | 12/1966 | Kenneday | 166/255.1 X |
| 3,570,594 | 3/1971 | Hamilton | 166/64 |
| 5,113,703 | 5/1992 | Hearn | 166/255.1 X |
| 5,234,053 | 8/1993 | Connell | 166/250 |
| 5,279,366 | 1/1994 | Scholes | 166/254 |
| 5,429,190 | 7/1995 | Kilgore et al. | 166/255 |
| 5,469,916 | 11/1995 | Sas-Jaworsky et al. | 166/64 |

*Primary Examiner*—Hoang C. Dang

*Attorney, Agent, or Firm*—Stephen R. Christian; C. Clark Dougherty, Jr.

[57] ABSTRACT

A well pipe string joint locator for attachment to the end of a length of coiled tubing and moved within the pipe string as the coiled tubing is lowered or raised therein is provided as well as methods of using the joint locator. The joint locator is comprised of an elongated tubular housing having a longitudinal fluid flow passageway therethrough and having at least one lateral port extending through a side thereof. Electronic means are disposed within the housing for detecting the increased mass of a pipe joint as said locator is moved through the joint and generating a momentary electric output signal in response thereto. Valve means are disposed within the housing responsive to the electric signal for momentarily opening or closing the lateral port of the housing to thereby create a surface detectible pressure drop or rise.

20 Claims, 2 Drawing Sheets

COILED TUBING JOINT LOCATOR AND METHODS

BACKGROUND OF THE INVENTION

1. Field of the Invention

The present invention relates generally to subterranean pipe string joint locators, and more particularly, to a joint locator and methods for positioning a well tool connected to coiled tubing in a well.

2. Description of the Prior Art

In the drilling and completion of oil and gas wells, a well bore is drilled into the subterranean producing formation or formations. A string of pipe, e.g., casing, is typically then cemented in the well bore, and a string of additional pipe, known as production tubing, for conducting produced fluids out of the well bore is disposed within the cemented string of pipe. The subterranean strings of pipe are each comprised of a plurality of pipe sections which are threadedly jointed together. The pipe joints, also often referred to as collars, are of increased masses as compared to other portions of the pipe sections.

It is often necessary to precisely locate one or more of the pipe joints of the casing, a liner or the production tubing in a well. This need arises, for example, when it is necessary to precisely locate a well tool such as a packer within one of the pipe strings in the well bore. The well tool is typically lowered into the pipe string on a length of coiled tubing, and the depth of a particular pipe joint adjacent or near the location to which the tool is to be positioned can be readily found on a previously recorded joint and tally log for the well. That is, after open hole logs have been run in a drilled well bore and one or more pipe strings have been cemented therein, an additional log is typically run within the pipe strings. The logging tools used include a pipe joint locator whereby the depths of each of the pipe joints through which the logging tools are passed is recorded. The logging tools generally also include a gamma ray logging device which records the depths and the levels of naturally occurring gamma rays that are emitted from various well formations. The additional log is correlated with the previous open hole logs which results in a very accurate record of the depths of the pipe joints across the subterranean zones of interest referred to as the joint and tally log. Given this readily available pipe joint depth information, it would seem to be a straightforward task to simply lower the well tool connected to a length of coiled tubing into the pipe string while measuring the length of coiled tubing in the pipe string by means of a conventional surface coiled tubing measuring device until the measuring device reading equals the depth of the desired well tool location as indicated on the joint and tally log. However, no matter how accurate the coiled tubing surface measuring device is, the true depth measurement is flawed due to effects such as coiled tubing stretch, elongation from thermal effects, sinusoidal and helical buckling, and a variety of other often unpredictable deformations in the length of coiled tubing suspended in the well bore.

Heretofore, attempts have been made to more accurately control the depth of well tools connected to coiled tubing. For example, a production tubing end locator has been utilized attached at the end of the coiled tubing. The production tubing end locator tool usually consists of collets or heavy bow springs that spring outwardly when the tool is lowered beyond the end of the production tubing string. When the coiled tubing is raised and the tool is pulled back into the production tubing string, a drag force is generated by the collets or bow springs that is registered by a weight indicator at the surface.

The use of such production tubing string end locator tools involve a number of problems. The most common problem is that not all wells include production tubing strings and only have casing or are produced open hole. Thus, in those wells there is no production pipe string for the tool to catch on while moving upwardly. Another problem associated with using the lower end of the production tubing string as a location point is that the tubing end may not be accurately located with respect to the producing zone. Tubing section lengths are tallied as they are run in the well and mathematical or length measurement errors are common. Even when the tubing sections are measured and tallied accurately, the joint and tally log can be inaccurate with respect to where the end of the tubing string is relative to the zone of interest. Yet another problem in the use of production tubing end locator tools is that a different size tool must be used for different sizes of tubing. Further, in deviated or deep wells, the small weight increase as a result of the drag produced by the end locator tool is not enough to be noticeable at the surface.

While a variety of other types of pipe string joint indicators have been developed including slick line indicators that produce a drag inside the tubing string, wire line indicators that send an electronic signal to the surface by way of electric cable and others, they either can not be utilized as a component in a coiled tubing-well tool system or have disadvantages when so used.

Thus, there is a need for an improved coiled tubing joint locator tool and methods of using the tool whereby the locations of pipe string joints can accurately be determined as the coiled tubing is lowered in a well and while fluid is flowed through the coiled tubing into a pipe string in which it is located.

SUMMARY OF THE INVENTION

By the present invention, an improved coiled tubing joint locator and methods of using the locator are provided which meet the needs described above, do not require the use of electric cable and overcome the other shortcomings of the prior art.

The joint locator of this invention is adapted to be attached to the end of a length of coiled tubing and moved within a pipe string as the coiled tubing is lowered or raised therein. The joint locator includes an elongated tubular housing having a longitudinal fluid flow passageway therethrough so that a fluid can be flowed through the coiled tubing and the joint locator, and having at least one lateral port extending through a side thereof which communicates with the fluid flow passageway. Electronic means which do not block the housing fluid flow passageway are disposed within the housing for detecting the increased mass of a pipe joint as the locator is moved through the pipe joint and for generating a momentary electric output signal in response thereto. Valve means which do not block the fluid flow passageway of the housing are disposed within the housing for momentarily opening or closing the lateral port of the housing in response to the electric output signal to thereby create a surface detectable pressure drop or rise in the fluid flowing through the coiled tubing and the joint locator indicative of the location of the pipe joint.

Methods of using the above described pipe string joint locator are also provided. The methods basically comprise connecting a pipe string joint locator of this invention to the end of a length of coiled tubing which automatically momentarily opens or closes a valved lateral port therein each time it moves through a pipe joint. The coiled tubing having the joint locator connected thereto is injected into the pipe string and moved therethrough while flowing fluid through the coiled tubing and through the joint locator. When the valved port of the joint locator momentarily opens or closes as a result of passing through a pipe string joint, a surface detectable pressure drop or rise in the flowing fluid indicative of the location of the pipe joint is produced. The depth of the joint locator and the surface pressure of the flowing fluid are continuously measured, and the measured depths of the joint locator corresponding to the detected pressure drops or rises in the flowing fluid are recorded to produce an accurate record of the depth of each detected pipe joint.

It is, therefore, a general object of the present invention to provide an improved coiled tubing joint locator and methods of using the locator.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

After a well has been drilled, completed and placed on production, it is often necessary to service the well whereby procedures are performed therein such as perforating, setting plugs, setting cement retainers, spotting permanent packers and the like. Such procedures are often carried out by utilizing coiled tubing. Coiled tubing is a relatively small flexible tubing, e.g., 1 to 2 inches in diameter, which can be stored on a reel when not being used. When used for performing well procedures, the tubing is passed through an injector mechanism and a well tool is connected to the end thereof. The injector mechanism pulls the tubing from the reel, straightens the tubing and injects it through a seal assembly at the well head, often referred to as a stuffing box. Typically, the injector mechanism injects thousands of feet of the coiled tubing with the well tool connected at the bottom end thereof into the casing string or the production tubing string of the well. A fluid, most often a liquid such as salt water, brine or a hydrocarbon liquid, is circulated through the coiled tubing for operating the well tool or other purpose. The coiled tubing injector at the surface is used to raise and lower the coiled tubing and the well tool during the service procedure and to remove the coiled tubing and well tool as the tubing is rewound on the reel at the end of the procedure.

Figure 1:
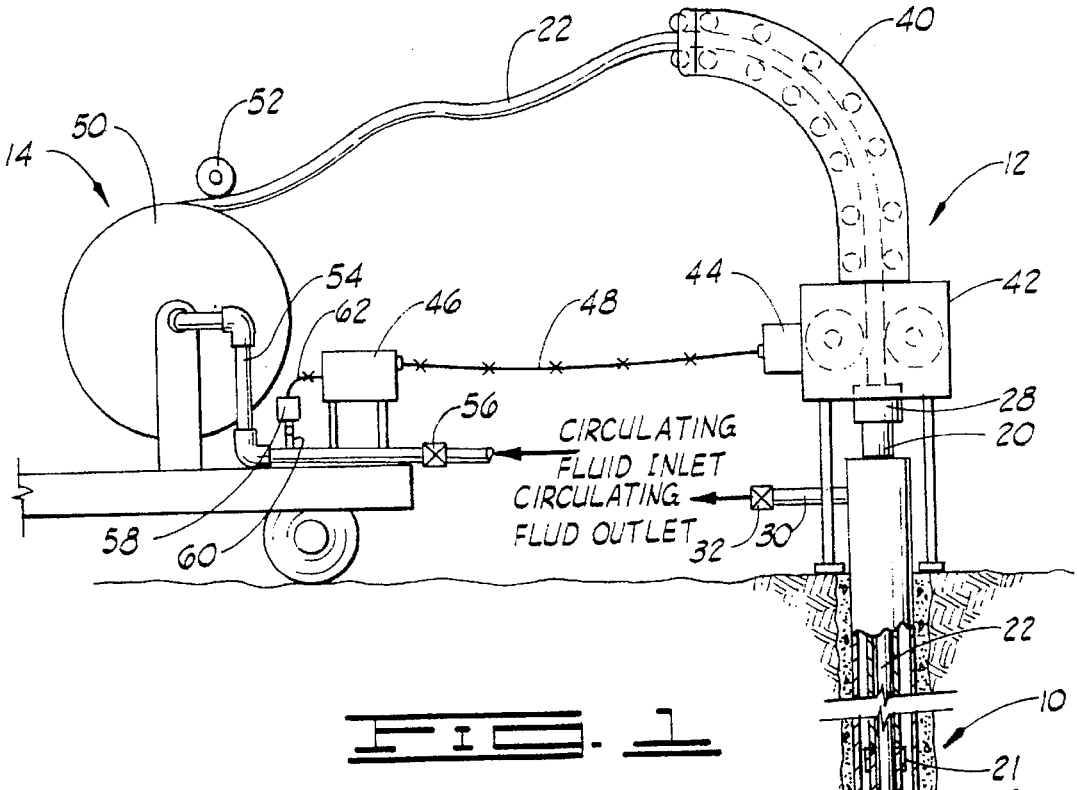
FIG. 1 is a schematic illustration of a cased well having a string of production tubing disposed therein and having a length of coiled tubing with the joint locator of the present invention connected thereto inserted therein by way of a coiled tubing injector and truck mounted reel.

Referring now to FIG. 1, a well 10 is schematically illustrated along with a coiled tubing injector 12 and a truck mounted coiled tubing reel assembly 14. The well 10 includes a well bore 16 having a string of casing 18 cemented therein in the usual manner. A string of production tubing 20 is also installed in the well 10 within the casing string 18. A length of coiled tubing 22 is inserted in the tubing string 20 having a joint locator of the present invention 24 connected at the bottom end thereof and a well tool 26 connected to the bottom end of the joint locator 24.

The coiled tubing 22 is inserted into the well 10 by way of a stuffing box 28 attached to the upper end of the tubing string 20. The stuffing box 28 functions to provide a seal between the coiled tubing and the production tubing whereby pressurized fluids within the well are prevented from escaping to the atmosphere. A circulating fluid removal conduit 30 having a shut-off valve 32 therein is sealingly connected to the top of the casing string 18. The fluid circulated into the well 10 by way of the coiled tubing 22 is removed from the well by way of the conduit 30 and valve 32 from where it is routed to a pit, tank or other fluid accumulator.

The coiled tubing injector mechanism 12 is of a design known to those skilled in the art and functions to straighten the coiled tubing and inject it into the well 10 by way of the stuffing box 28. The coiled tubing injector 12 is comprised of a straightening mechanism 40 having a plurality of internal guide rollers therein and a coiled tubing drive mechanism 42 for inserting the coiled tubing into the well, raising it or lowering it within the well and removing it from the well as it is rewound on the reel of the assembly 14. A depth measuring device 44 is connected to the coiled tubing drive mechanism 42. The measuring device 44 functions to continuously measure the length of the coiled tubing within the well 10 and provide that information to an electronic data acquisition system 46 which is part of the truck mounted reel assembly 14 by way of an electric transducer (not shown) and an electric cable 48.

Figure 4:
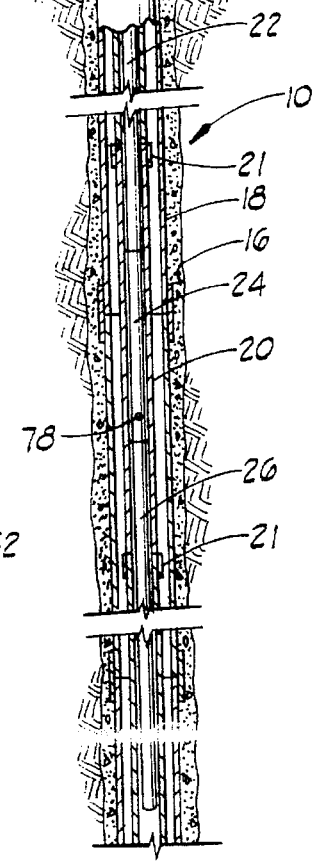
FIG. 4 is a schematic illustration of a strip chart containing recorded information produced in accordance with this invention and a previously recorded joint and tally log.
Figure 4:
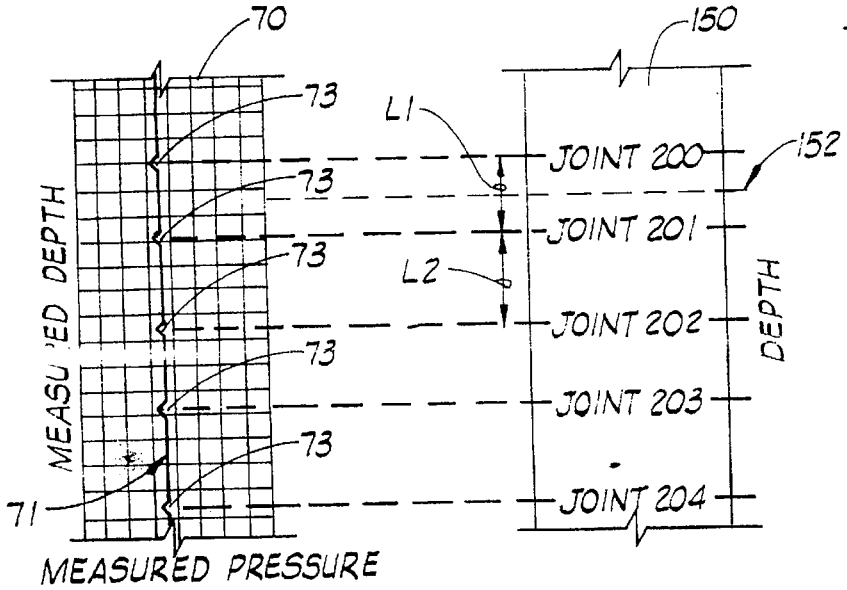

The truck mounted reel assembly 14 includes a reel 50 for containing coils of the coiled tubing 22. A guide wheel 52 for guiding the coiled tubing 22 on and off the reel 50 is provided and a conduit assembly 54 is connected to the end of the coiled tubing 22 on the reel 50 by way of a swivel system (not shown). A shut-off valve 56 is disposed in the conduit assembly 54 and the conduit assembly 54 is connected to a fluid pump (not shown) which pumps the fluid to be circulated from a pit, tank or other fluid accumulator through the conduit assembly 54 and into the coiled tubing 22. A fluid pressure sensing device and transducer 58 is connected to the conduit assembly 54 by way of a connection 60 attached thereto and to the data acquisition system 46 by an electric cable 62. As will be understood by those skilled in the art, the data acquisition system 46 functions to continuously record the depth of the coiled tubing 22 and the joint locator attached thereto in the well 10 and the surface pressure of the fluid being pumped through the coiled tubing and joint locator such as is shown on the strip chart 70 of FIG. 4.

Figure 2:
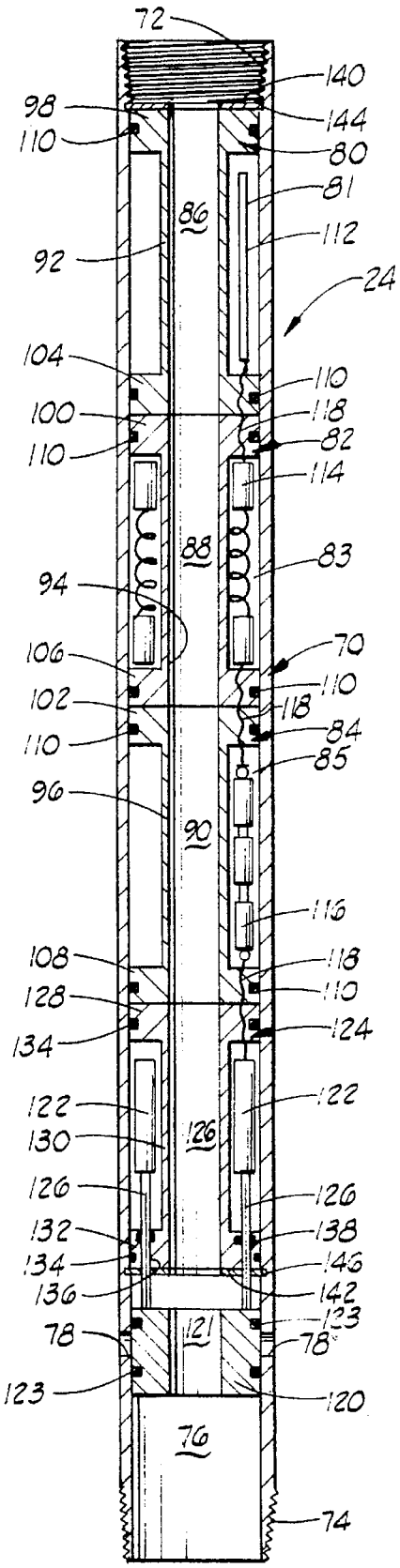
FIG. 2 is a side cross-sectional view of the joint locator of the present invention with the valved ports thereof closed.
Figure 3:
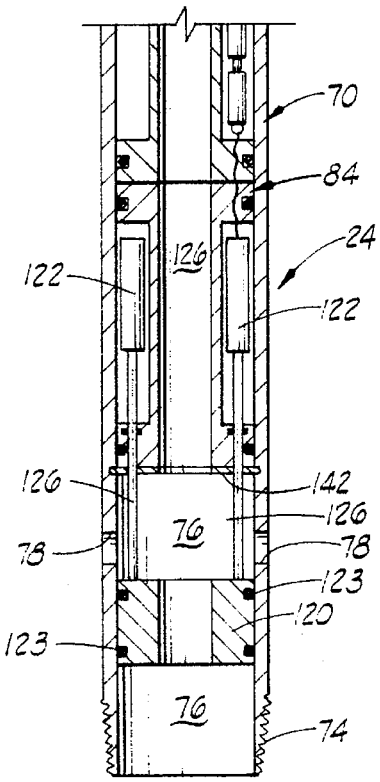
FIG. 3 is a partial cross-sectional view of the lower portion of the joint locator of FIG. 2 after the valved ports have been opened.

Referring now to FIGS. 2 and 3, the joint locator 24 of the present invention is illustrated in detail. The joint locator 24 includes an elongated cylindrical housing 70 having an internally threaded box connection 72 at the upper end for connecting the housing 70 to a complimentary connection of a coupling (not shown) attached to the end of the coiled tubing 22. An externally threaded pin connection 74 is provided at the bottom end of the housing 70 for connecting the joint locator 24 to a well tool. The housing 70 is hollow and includes a fluid passageway 76 which extends through it. The housing 70 also includes lateral ports 78 extending through the side thereof which communicate with the passage 76.

Electronic components are disposed within the housing without blocking the fluid flow passageway 76 for detecting the increased mass of a pipe joint as the joint locator 24 is moved through the pipe joint and generating a momentary electric output signal in response thereto. In addition, an electric signal operated valve system responsive to the output signal generated by the electronic components which also does not block the fluid flow passageway 76 is disposed in the lower portion of the housing 70 for momentarily opening or closing the lateral ports 78 thereof. As mentioned above, the momentary opening or closing of the ports 78 creates a surface detectible pressure drop or rise in the fluid flowing through the coiled tubing 22 and the joint locator 24 which is indicative of the location of the detected pipe joint.

The electronic components of the joint locator 24 are contained within three annular containers 80, 82 and 84 which are sealingly stacked within the housing 70 and which are electronically connected. As best shown in FIG. 2, each of the annular containers 80, 82 and 84 include central openings 86, 88 and 90, respectively, whereby they do not block the flow passageway 76 through the housing 70. Each of the annular containers 80, 82 and 84 include internal cylindrical sides 92, 94 and 96, respectively, annular tops 98, 100 and 102, respectively, and annular bottoms 104, 106 and 108, respectively. The external cylindrical sides of the tops and bottoms of the annular containers 80, 82 and 84 fit snugly against internal cylindrical surfaces of the housing 70 and conventional O-ring seals and grooves, generally designated by the numeral 110, are disposed therein for providing seals between the housing and the annular containers.

The annular space 81 provided within the annular container 80 contains electronic circuit boards and other electronic components 112, the annular space 83 within the annular container 82 contains an electromagnetic coil assembly 114 and the annular space 85 of the annular container 84 contains a power source made up of a plurality of batteries 116. The electronic circuit boards and other components 112 within the annular container 80 are interconnected with the electromagnetic coil assembly 114 within the annular container 82 and the power source 116 within the annular container 84 by electric wires and contacts generally designated by the numeral 118.

The valve system which is responsive to the electric output signal generated by the electronic components described above is comprised of a moveable cylindrical valve member 120 having a central opening 121 therein and one or more electric signal responsive solenoids 122. The solenoids 122 are disposed within a fourth annular container 124 connected to the valve member 120 by one or more valve stems 126. The annular container 124 is identical to the previously described annular containers 80, 82 and 84, and includes a central cylindrical opening 126, an annular top 128, a cylindrical internal side 130 and an annular bottom 132. The annular top 128 and annular bottom 132 include O-ring seals and grooves generally designated by the numeral 134, and the annular bottom 132 further includes vertical bores 136 and O-ring seals and grooves 138 through which the valve stems 126 sealingly extend. The valve member 120 is shown in FIG. 2 in the closed position whereby it covers the ports 78. The outside cylindrical surface of the valve member 120 includes O-ring seals and grooves 123 positioned on opposite sides of the ports 78 for providing seals between the ports 78 and the passageway 76 of the housing.

The annular containers 80, 82, 84 and 124 are maintained within the housing 70 by a pair of snap rings 140 and 142, or equivalent devices, engaged in grooves 144 and 146 in the housing 70. Electric wires and contacts 118 connect between the solenoids 122 in the annular container 124 and the previously described electronic components in the other annular containers.

In the operation of the joint locator 24, it is connected to a well tool 26 by means of the threaded pin joint 74 and to a length of coiled tubing 22 by means of the box joint 72 as illustrated in FIG. 1. As the coiled tubing 22 is raised or lowered in the well 10 and the joint locator 24 passes through a pipe joint 21 of the production tubing string 20, the electromagnetic coil assembly 114 (FIG. 2) electromagnetically senses the increased mass of the pipe joint. The electronic circuit boards and other components 112 generate a momentary electric output signal which is received by the solenoids 122 of the valve system within the joint locator 24. That is, the momentary electric output signal activates the solenoids 122 whereby they momentarily open the ports 78 by moving the valve stems 126 and cylindrical valve 120 from the closed position shown in FIG. 2 to the open position shown in FIG. 3. Thus, in the arrangement just described, the valve 120 is normally in the closed position whereby the ports 78 are closed and when a pipe joint is detected, the valve is momentarily moved to the opened position which in turn causes a surface detectible pressure drop in the fluid flowing through the joint locator 24. The pressure drop occurs because the fluid also flows through the well tool 26 connected below the joint locator 24 which restricts the flow of fluid and increases the pressure of the fluid. As will be understood by those skilled in the art, when the ports 78 of the joint locator 24 are momentarily opened, the fluid flowing through the joint locator 24 is released directly to the pipe string 20 without flowing through the well tool 26 thereby causing a detectible surface pressure drop.

In applications where the flow of fluid is unrestricted below the joint locator 24 or a well tool is attached to the joint locator 24 which does not permit the flow of fluid therethrough, the joint locator 24 can be operated in a mode whereby the ports 78 are normally open, i.e., the circulated fluid normally flows through the joint locator 24 and into the pipe string 20 by way of the ports 78. When a pipe joint 21 is detected, the valve 20 is momentarily closed which causes a surface detectible pressure rise. As will be understood, various other fluid flow arrangements through the joint locator 24 can be utilized. For example, small ports that are always open as well as larger ports which are normally closed can be included in the joint locator 24, or other similar arrangements can be used depending upon the particular well tool used and its operation.

Referring now to FIG. 1, the methods of this invention for accurately determining the depth of subterranean pipe string joints while lowering or raising coiled tubing within the pipe string and flowing fluid through the coiled tubing into the pipe string basically comprise the following steps. A pipe string joint locator 24 is connected to the end of the coiled tubing 21 prior to injecting the coiled tubing into the pipe string 20. The coiled tubing 22 having the joint locator 24 connected thereto is next injected into the pipe string 20 and moved therethrough while flowing fluid through the coiled tubing 22 and the joint locator 24 whereby the valved lateral ports 78 of the joint locator 24 momentarily open or close each time it passes through a pipe joint 21 thereby creating a surface detectible pressure drop or rise in the flowing fluid indicative of the location of the pipe joint. The depth of the joint locator 24 and the surface pressure of the flowing fluid are continuously measured. That is, the depth measuring device 44 continuously measures the depth of the joint locator 24 and the pressure sensor 58 continuously measures the surface pressure of the circulating fluid. The final step in the method is the recordation of the measured depths of the joint locator 24 corresponding to each detected pressure drop or rise in the flowing fluid to thereby accurately determine the depth of each detected pipe joint. Referring again to FIG. 1, this step is accomplished by the data acquisition system 46 which constantly receives the measured depth information from the depth measuring device 44 and surface pressure information from the pressure sensor 58 and records the information, such as on a strip chart like the strip chart 70 illustrated in FIG. 4. The strip chart 70 shows the depth measured by the measuring device 44 along the vertical axis and the measured pressure along the horizontal axis. The continuously measured pressure is indicated by the line 71 and the surface pressure drops 73 indicate the depths of detected pipe joints.

When a well tool 26 is connected to the joint locator 24 as shown in FIG. 1, the well tool 26 is positioned at a desired location where the well tool is to be operated to achieve a desired result in accordance with the following method. The joint locator 24 is connected to the end of the coiled tubing 22 and a well tool 26 is connected to the end of the joint locator as shown in FIG. 1. The coiled tubing 22 having the joint locator 24 and well tool 26 connected thereto is then injected into a pipe string such as the production tubing string 20 of the well 10 and lowered therein to the general vicinity of the subterranean zone where the well tool 26 is to be operated. The coiled tubing 22, joint locator 24 and well tool 26 are moved through the portion of the pipe string 20 traversing the zone of interest while flowing fluid through the coiled tubing, the joint locator and the well tool, or flowing the fluid through the ports 78 of the joint locator and not through the well tool, whereby the valved lateral ports 78 of the joint locator momentarily open or close each time the joint locator passes through a pipe joint 21. As described above, the opening or closing of the valved lateral ports 78 creates a surface detectible pressure drop or rise in the flowing fluid indicative of the location of the detected pipe joint. The depth of the joint locator and the surface pressure of the flowing fluid are continuously measured by the measuring device 44 and pressure sensor 58 as described above. The measured depth of the joint locator corresponding to each detected pressure drop or rise in the flowing fluid are recorded on a strip chart such as the strip chart 70 illustrated in FIG. 4 to thereby accurately determine the depth of each detected pipe joint as measured by the measuring device 44.

In order to positively identify the particular pipe joints 21 detected in the zone of interest and to establishing a depth measured by the measuring device 44 corresponding to the exact position where the well tool is to be operated, the strip chart 70 and the information shown thereon is compared with a previously recorded joint and tally log 150 for the well. For example, and referring to FIG. 4, the strip chart 70 covering the zone of interest produced by the data acquisition system 46 (FIG. 1) is shown in a side by side comparison with the portion of the joint and tally log 150 covering the same zone. Since the pipe sections making up the pipe string have different lengths, i.e., the length L1 of the pipe section between joints 200 and 201 is smaller than the length L2 of the pipe section between joints 201 and 202, the section lengths on the strip chart 70 can be correlated to the section lengths on the joint and tally log 150 and the identification of the joints detected by the joint locator 24 can be verified. Once the correlation of the strip chart 70 has been made to the joint and tally log 150, the depth of the desired well tool location as measured by the coiled tubing measuring device 44 can be determined. That is, if the desired location is at a depth designated by the numeral 152 on the joint and tally log 150 between joints 200 and 201, the corresponding depth measured by the coiled tubing measuring device 44 on the strip chart 70 can be determined. After such determination, the coiled tubing 22, joint locator 24 and well tool 26 are moved within the pipe string 20 to position the well tool 26 at the desired location.

Thus, the present invention is well adapted to carry out the objects and advantages mentioned as well as those which are inherent therein. While numerous changes may be made by those skilled in the art, such changes are encompassed within the spirit of this invention as defined by the appended claims.

What is claimed is:

1. A well pipe string joint locator adapted to be attached to the end of a length of coiled tubing and moved within the pipe string as the coiled tubing is lowered or raised therein comprising:

an elongated tubular housing having connecting means at the upper end thereof for attaching said housing to said coiled tubing, having a longitudinal fluid flow passageway therethrough so that a fluid can be flowed through said coiled tubing and through said locator and having at least one lateral port extending through a side thereof which communicates with said fluid flow passageway;

electronic means disposed within said housing without blocking said fluid flow passageway for detecting the increased mass of a pipe joint as said locator is moved through said pipe joint and generating a momentary electric output signal in response thereto; and valve means disposed within said housing without blocking said fluid flow passageway for momentarily opening or closing said lateral port of said housing in response to said electric signal to thereby create a surface detectable pressure drop or rise in said fluid flowing through said coiled tubing and said locator indicative of the location of said pipe joint.

2. The joint locator of claim 1 wherein said housing further includes connecting means at the lower end thereof for attaching one or more well tools to said joint locator.

3. The joint locator of claim 1 wherein said electronic means for detecting the increased mass of a pipe joint and generating a momentary electric output signal in response thereto electromagnetically senses said increased mass.

4. The joint locator of claim 1 wherein said electronic means for detecting the increased mass of a pipe joint and generating a momentary electric output signal in response thereto comprises an electric power source, an electromagnetic coil and electronic circuit means connected to said power source and to said coil for generating said electric output signal when said coil electromagnetically senses the increased mass of a pipe joint.

5. The joint locator of claim 1 wherein said valve means for momentarily opening or closing said lateral port of said housing in response to said electric signal comprises a valve positioned adjacent said port which is movable between open and closed positions and an electric signal responsive solenoid connected to said valve for moving said valve whereby said port is momentarily opened or closed.

6. A method of accurately determining the depth of subterranean pipe string joints while lowering or raising coiled tubing within said pipe string and flowing fluid through said coiled tubing comprising the steps of:

connecting a pipe string joint locator to the end of said coiled tubing prior to injecting said coiled tubing into said pipe string, said joint locator having a fluid flow passageway therethrough and at least one valved lateral port therein communicated with said passageway and said joint locator momentarily opening or closing said valved lateral port each time it moves through a pipe joint;

injecting said coiled tubing having said joint locator connected thereto into said pipe string and moving said coiled tubing and said joint locator through said pipe string while flowing fluid through said coiled tubing and said joint locator whereby said valved lateral port of said joint locator momentarily opens or closes each time said joint locator passes through a pipe joint thereby creating a surface detectible pressure drop or rise in the flowing fluid indicative of the location of said pipe joint;

continuously measuring the depth of said joint locator and the surface pressure of said flowing fluid; and recording the measured depth of said joint locator corresponding to each detected pressure drop or rise in the flowing fluid to thereby accurately determine the measured depth of each detected pipe joint.

7. The method of claim 6 wherein said joint locator detects said pipe joints electromagnetically.

8. The method of claim 6 which further comprises connecting one or more well tools to the end of said joint locator opposite from the end thereof connected to said coiled tubing.

9. The method of claim 6 wherein said joint locator includes electronic means for detecting the increased mass of a pipe joint as said locator is moved through said pipe joint and generating a momentary electric output signal in response thereto, and valve means responsive to said electric signal for momentarily opening or closing said valved lateral port to thereby create said surface detectible pressure drop or rise.

10. The method of claim 9 wherein said electronic means for detecting the increased mass of a pipe joint comprise an electric power source, an electromagnetic coil and electronic circuit means connected to said power source and to said coil for generating said momentary electric output signal when said coil electromagnetically senses said increased mass of said pipe joint.

11. The method of claim 9 wherein said valve means responsive to said electric output signal for momentarily opening or closing said valved lateral port comprises a valve positioned adjacent said port which is movable between open and closed positions and an electric signal responsive solenoid for moving said valve connected thereto.

12. A method of positioning a well tool attached to the end of a length of coiled tubing at a desired location within a subterranean pipe string disposed in a well while flowing fluid into said pipe string comprising the steps of:

connecting a pipe string joint locator to the end of said coiled tubing, said joint locator having a fluid flow passageway therethrough and at least one valved lateral port therein communicated with said passageway and said joint locator momentarily opening or closing said valved lateral port each time it moves through a pipe joint;

connecting said well tool to the end of said joint locator opposite from the end thereof connected to said coiled tubing;

injecting said coiled tubing having said joint locator and said well tool connected thereto into said pipe string and moving said coiled tubing, said joint locator and said well tool through said pipe string while flowing fluid through said coiled tubing and said joint locator whereby said valved lateral port of said joint locator momentarily opens or closes each time said joint locator passes through a pipe joint thereby creating a surface detectible pressure drop or rise in the flowing fluid indicative of the location of said pipe joint;

continuously measuring the depth of said joint locator and the surface pressure of said flowing fluid;

recording the measured depth of the joint locator corresponding to each detected pressure drop or rise in the flowing fluid to thereby accurately determine the measured depth of each detected pipe joint;

correlating the measured depths of the detected pipe joints to a previously recorded joint and tally log in a manner establishing a measured depth corresponding to the well tool desired location; and moving said coiled tubing, joint locator and well tool within said pipe string to position said well tool at said desired location.

13. The method of claim 12 wherein said joint locator detects said pipe joints electromagnetically.

14. The method of claim 12 wherein said joint locator includes electronic means for detecting the increased mass of a pipe joint as said locator is moved through said pipe joint and generating a momentary electric output signal in response thereto, and valve means responsive to said electric signal for momentarily opening or closing said valved lateral port to thereby create said surface detectible pressure drop or rise.

15. The method of claim 14 wherein said electronic means for detecting the increased mass of a pipe joint comprise an electric power source, an electromagnetic coil and electronic circuit means connected to said power source and to said coil for generating said momentary electric output signal when said coil electromagnetically senses said increased mass of said pipe joint.

16. The method of claim 15 wherein said valve means responsive to said electric output signal for momentarily opening or closing said valved lateral port comprises a valve positioned adjacent said port which is movable between open and closed positions and an electric signal responsive solenoid for moving said valve connected thereto.

17. The method of claim 16 wherein said fluid is a liquid.

18. The method of claim 17 wherein said liquid is selected from the group consisting of fresh water, salt water, brine and hydrocarbon liquids.

19. The method of claim 18 wherein said liquid flows through said well tool, and said valved port of said joint locator is momentarily opened when it passes through a pipe joint.

20. The method of claim 18 wherein said liquid does not flow through said well tool and said valved port of said joint locator is momentarily closed when it passes through a pipe joint.

* * * * *